US005419818A

United States Patent [19]

Wanngard

[11] Patent Number: 5,419,818

[45] Date of Patent: May 30, 1995

[54] PROCESS FOR THE PRODUCTION OF ALKALI METAL CHLORATE

[75] Inventor: Johan Wanngard, Sundsvall, Sweden

[73] Assignee: Eka Nobel AB, Bohus, Sweden

[21] Appl. No.: 233,330

[22] Filed: Apr. 26, 1994

[30] Foreign Application Priority Data

Apr. 26, 1993 [SE] Sweden ..... 9301391

[51] Int. Cl.[6] ..... C25B 1/16; C25B 1/22; C25B 1/24

[52] U.S. Cl. ..... 204/95; 204/94; 204/86; 204/98; 204/103; 204/128; 423/478

[58] Field of Search ..... 204/94, 95, 98, 128, 204/101, 103, 106; 423/478

[56] References Cited

U.S. PATENT DOCUMENTS 5,256,261 10/1993 Lipsztajn et al. ..... 204/128

FOREIGN PATENT DOCUMENTS 0498494 8/1992 European Pat. Off. .

*Primary Examiner*—Kathryn Gorgos

*Attorney, Agent, or Firm*—Burns, Doane, Swecker & Mathis

[57] ABSTRACT

The invention relates to a process for electrolytic production of alkali metal chlorate where the demand of pH-adjusting chemicals is largely covered by integrated production of acid and alkali metal hydroxide. The process consists in electrolyzing a partial flow of chlorate electrolyte produced, in a cell provided with a separator, for producing a catholyte containing alkali metal hydroxide and an anolyte containing hydrochloric acid. The catholyte and the anolyte are used in alkalization and acidification in the chlorate process, thus significantly reducing the admission of impurities via externally produced chemicals.

19 Claims, 1 Drawing Sheet

PROCESS FOR THE PRODUCTION OF ALKALI METAL CHLORATE

Figure 1:
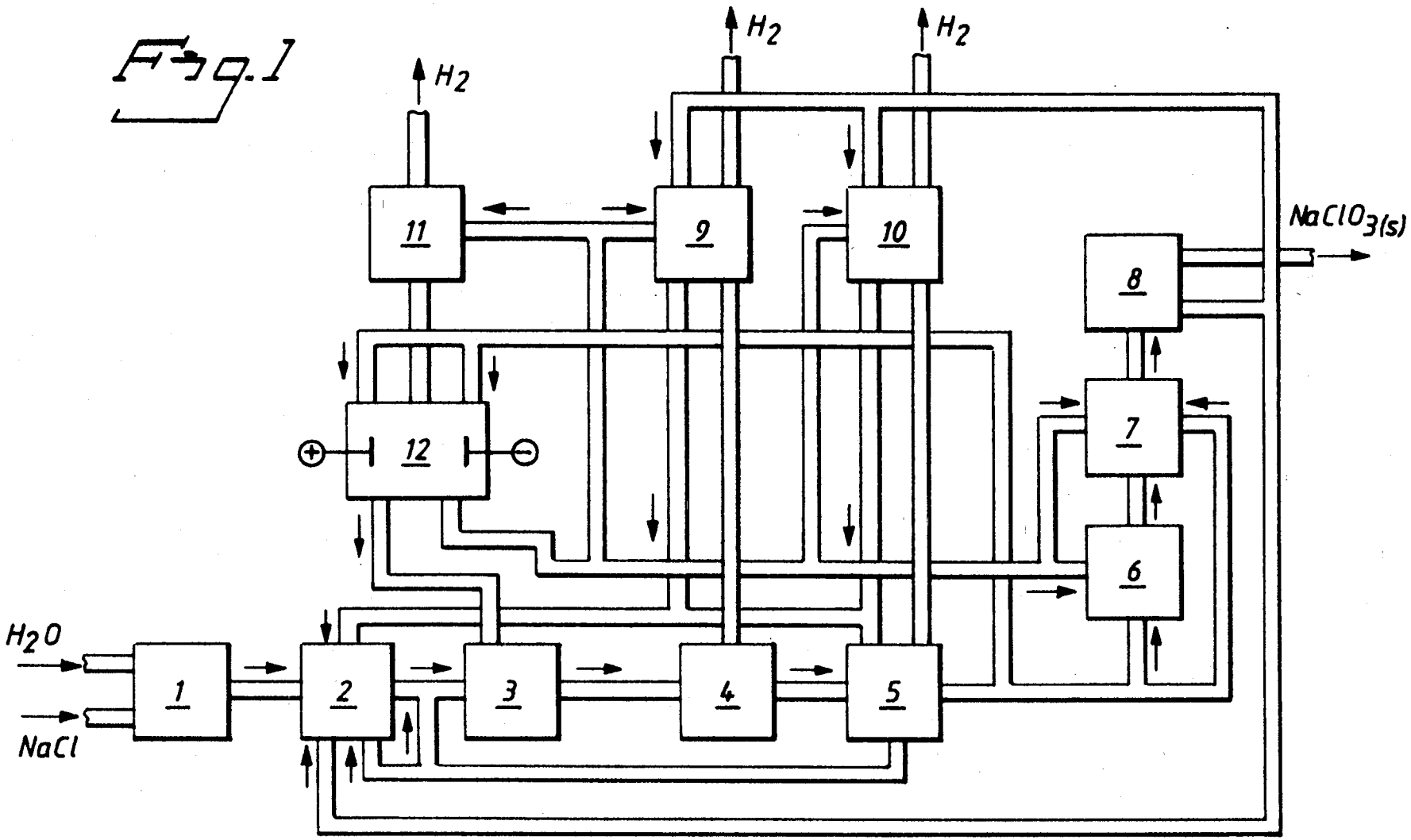

The present invention relates to a process for electrolytic production of alkali metal chlorate, where the demand for pH-adjusting chemicals is largely covered by integrated production of acid and alkali metal hydroxide. In the process, partial flow of produced chlorate electrolyte is electrolyzed in a cell provided with a separator, for producing a catholyte containing alkali metal hydroxide, and an anolyte containing hydrochloric acid. The catholyte and the anolyte are used in alkalization and acidification in the chlorate process, thus substantially reducing the admission of impurities from externally produced chemicals.

BACKGROUND OF THE INVENTION

Alkali metal chlorate, and especially sodium chlorate, is an important chemical in the cellulose industry, where it is used as raw material in the production of chlorine oxide, which is an important bleaching chemical for cellulose fibres.

Alkali metal chlorate is produced by electrolysis of a chloride-enriched aqueous electrolyte according to the overall formula:

$$MeCl + 3H_2O \rightarrow MeClO_3 + 3H_2 \quad (1)$$

wherein Me =alkali metal.

The process is a cyclic process; where, in a first step, the chloride electrolyte is passed to an electrolyzer for the formation of hypochlorite, whereupon the resulting chlorate electrolyte is conducted to reactor vessels for further reaction to form chlorate. The chlorate formed is separated by crystallization while the mother liquor is recycled for preparing chloride electrolyte for further electrolysis to form hypochlorite.

In the cyclic chlorate process, pH is adjusted in several positions within the range 5.5–12, to optimize the process conditions for the respective unit operation. Thus, a weakly acid or neutral pH is used in the electrolyzer and in the reaction vessels to promote the reaction from chlorine via hypochlorite to chlorate, while the pH in the crystallizer is alkaline to prevent gaseous hypochlorite and chlorine from being released and to reduce the risk of corrosion.

In acidification, hydrochloric acid is normally used, but chlorine also occurs. To make the solutions alkaline, use is most often made of alkali metal hydroxide. Hydrochloric acid and alkali metal hydroxide are added in the form of aqueous solutions. Commercially available technical-grade solutions of hydrochloric acid and alkali metal hydroxide contain impurities which may derive from the chlorine/alkali plant and/or from subsequent transportation and storage. A chloride electrolyte to be electrolyzed in a chlorate cell must not contain high contents of impurities. Thus, $Ca^{2+}$, $Mg^{2+}$and $SO_4^{2-}$ give rise to deposits on the cathodes and, hence, higher operating voltage and energy costs, while heavy metals decompose the formed hypochlorite into chloride and oxygen, and not into chlorate, as desirable.

Alkali metal hydroxide is used for alkalization of the chlorate electrolyte before crystallization of chlorate, in alkaline purifying processes and in the regeneration of ion-exchange resins. Further, alkali metal hydroxide is used for eliminating the presence of gaseous chlorine compounds. Chlorine compounds give rise to problems of odor, health and corrosion, and also contaminate the hydrogen gas which is formed and which is often used as raw material for different syntheses. Hydrochloric acid is used for acidification of the chlorate electrolyte before electrolysis. In this case, mixing must be very thorough to prevent the formation of, inter alia, chlorine and chlorine dioxide in local, strongly acid regions, entailing explosion risks and impaired working environment.

The production of chlorate requires considerable amounts of hydrochloric acid and alkali metal hydroxide, which means a considerable cost. Besides, the handling of acid and liquor is complicated because of the rigorous safety requirements placed on transport, storage and dosage. Further, the concentration of commercially available products is considerably higher than that immediately usable in the chlorate process.

EP-A-498 484 relates to a process for the production of alkali metal chlorate in combination with chlorine and alkali metal hydroxide, which auxiliary chemicals are used in the chlorate process. In the production of chlorine and alkali metal hydroxide according to this process, an electrolyte containing water from the condenser of the chlorate crystallizer and purified alkali metal chloride is electrolyzed. The production of chlorine and alkali metal hydroxide relates to a chlorine-alkalicell. A catholyte is recirculated in the cathode compartment with a composition of 30 weight-% sodium hydroxide which is equivalent to pH 15. An anolyte of very purified sodium chloride is recirculated in the anode compartment at pH 2 and chlorine gas is produced at the anode. Neither the anolyte nor the catholyte comprises chlorate and to both of them are added very purified water from the evaporation of chlorate electrolyte. The chlorine gas leaves the anode compartment and has to be burned with hydrogen gas to form hydrochloric acid which then can be added to the chlorate process for acidification, or have to be dissolved in a liquid in the process. Although this process entails a reduction of the admission of impurities, it requires extensive equipment, the risk of handling chlorine gas and retains the risk of local, strongly acid regions in the chlorate electrolyte in acidification.

THE INVENTION

The present invention provides an electrolytic process for producing alkali metal chlorate in an energy-efficient manner, involving significantly reduced health and environmental hazards, and making superfluous a large portion of the chemicals added in conventional processes for acidification and alkalization. The process comprises electrolysis in chlorate electrolyzers of an aqueous electrolyte containing purified alkali metal chloride, after which a partial flow of resulting chlorate electrolyte is electrolyzed in a cell equipped with a separator for providing a catholyte which contains alkali metal hydroxide and which is used at least partially in the production of alkali metal chlorate. Chlorine is produced in the anode compartment and is immediately dissolved and hydrolyzed to hypochlorous acid.

The invention thus relates to a process for the production of alkali metal chlorate having the features recited in the claims. The invention is directed to an integrated process wherein the main part of the proton and hydroxide-ion demand is met by electrolysis of chlorate electrolyte in a cell equipped with a separator. Thus, the electrolysis yields an anolyte and a catholyte having lower and higher pH, respectively, than in the chlorate electrolyte supplied.

The present invention reduces the need of externally produced acid and alkali metal hydroxide, thus decreasing the admission of impurities to the chlorate process. Moreover, there is a reduction of the risks in transportation, storage and dosage of acid and alkali metal hydroxide, in that the auxiliary chemicals are produced directly in the process. The use of a chromate buffer can also be reduced because the production of alkali metal hydroxide can easily be extended.

The present invention may advantageously be integrated in the production of chlorine dioxide. Thus, in certain types of integrated plants for chlorine dioxide production, it is not possible to supply alkali metal ions to the process. This applies primarily to processes for producing chlorine dioxide having the overall mass balance $$Cl_2+4H_2O \rightarrow 2ClO_2+4H_2 \quad (2)$$

Here, the alkali metal ion, primarily sodium, acts only as a counterion to the chlorate and chloride ions and is recycled to the chlorate electrolyte. Therefore, it is not possible to systematically supply alkali metal hydroxide, since this would result in an accumulation of alkali metal ions. The use of catholyte produced according to the inventive process for the production of chlorine dioxide in processes where alkali metal ions cannot be systematically supplied is highly advantageous, since hydroxide ions can be produced directly without using any counterion.

When carrying out the inventive process, a partial flow of the chlorate electrolyte is passed to a monopolar or a bipolar cell. The partial flow may consist of from about 3 to about 50 $m^3$/metric ton of alkali metal chlorate, suitably from 10 to 30 $m^3$/metric ton of alkali metal chlorate. Suitably, the chlorate electrolyte is withdrawn from the reactor vessels or the chlorate electrolyzers, preferably from the reactor vessels, since the chlorate electrolyte has been more completely reacted to chlorate ions in this position. The production of the chlorate electrolyte that is withdrawn from the reactor vessels or the chlorate electrolyzers and is supplied to the cell with the separator can be carried out such that the concentration of $ClO_3^-$ is in the range of from about 100 to about 1000 g/l, calculated as sodium chlorate, suitably from 300 to 650 g/l and preferably from 500 to 600 g/l, calculated as sodium chlorate. The production of the chlorate electrolyte that is withdrawn from the reactor vessels or the chlorate electrolyzers and is supplied to the cell with the separator can be carried out such that the concentration of $Cl^-$ is in the range of from about 30 to about 200 g/l, calculated as sodium chloride, suitably from 70 to 150 g/l and preferably from 100 to 130 g/l, calculated as sodium chloride.

In a cell provided with an anode having high oxygen overvoltage, chlorine gas is generated on the anode while hydrogen gas and hydroxide ions are obtained on the cathode side. The chlorine gas is dissolved immediately in the anolyte, i.e. the major part of the chlorine gas does not leave the cell, succeeded by partial hydrolysis to hypochlorous acid according to $$Cl_2+H_2O \rightarrow HClO+HCl \quad (3)$$

The hypochlorous acid is dissociated in the presence of a buffer or hydroxide ions ($B^-$) to hypochlorite according to $$HClO+B^- \rightarrow HB+ClO^- \quad (4)$$

The pH in the anolyte shall preferably not be below 4. In that case, as in EP-A-498484, chlorine gas will leave the anode compartment and have to be burned with hydrogen gas to hydrochloric acid, which then can be added to the chlorate process. Since hypochlorite is a desired product in the chlorate electrolyzers, it is especially advantageous to use such an anolyte for acidification of electrolyte supplied to the chlorate electrolyzers.

The pH of chlorate electrolyte supplied to the cell, provided with a separator, suitably ranges from about 5.0 to about 7.5, and preferably from 5.5 to 7.3. Thanks to the fact that the pH is high in the produced anolyte, it will not comprise chlorine gas. Instead an acidified chlorate electrolyte is immediately produced which can be added to the chlorate process.

The pH of the anolyte produced can be adjusted as required by controlling the anolyte flow to within the range of from about 0.5 to about 5 $m^3$/kAh, suitably from 1 to 3 $m^3$/kAh. By "kAh" it is here meant the total exposed faraday charge, i.e. the sum of the charges passed through each unit cell. The pH of the anolyte produced suitably ranges from about 4.5 to about 6.5, preferably from 5 to 6. Similarly, the pH of the catholyte produced is adjusted as required. The pH of the catholyte produced may range from about 9 to about 13, suitably from 10 to 12 and preferably from 10 to 11.

In the production of a substantially chlorate-free catholyte, the catholyte flow may be considerably lower than the above-mentioned anolyte flow. Thus, the catholyte flow may be in the range of from about 0.01 to about 0.1 $m^3$/kAh. In this case, the concentration of alkali metal hydroxide in the catholyte may range from about 13 to about 130 g/l, calculated as sodium hydroxide.

In the process of the invention, the temperature in the cell provided with a separator may be from about 20° to about 100° C., suitably from 40° to 80° C.

The electrodes in the cell with the separator may be conventional chlorate electrodes, suitably plane-parallel plates coated with e.g. $RuO_2/TiO_2$ or Pt/Ir. The cathode may consist of stainless or low-alloy steel or titanium, optionally activated with a platinum group metal. Suitably, a steel cathode is used.

In the electrolytic cell for producing catholyte containing alkali metal hydroxide, the anode and cathode compartments are separated by a separator. Suitably, the separator is a diaphragm or a membrane, preferably a diaphragm, which is substantially resistant to chlorine and alkali metal hydroxide. Using a diaphragm, charge-carrying ions can be transported in both directions. Thus, cations, primarily alkali metal ions, can migrate through the diaphragm from the anolyte to the catholyte, while anions, primarily chloride and chlorate ions, can migrate the opposite way. Using an ion-selective membrane as separator, this transport is, however, limited, for example to cations, primarily sodium.

"Diaphragm" as used herein means gas-separating constructions of inorganic materials based e.g. on asbestos, organic materials, such as fluorine-containing polymers, polyethylene, polypropylene and polyvinyl chloride, or a combination of such materials, such as a fluorine-containing polymer on a carrier of valve metal, such as titanium or zirconium (for example Polyramix® commercially available from Oxytech, USA).

The membranes used in the present process suitably are ion-selective. Ion-selective membranes may be cationic or anionic, preferably cationic. The use of a cationic-selective membrane and a chlorine-gas generating anode enables the production of concentrated alkali metal hydroxide having a low content of chlorate ions and chloride ions and a hydrochloric-acid chlorate-containing anolyte having an increased content of hypochlorous acid. In this case, the partial flow of chlorate electrolyte is supplied to the anode compartment while the required amount of water is supplied to the cathode compartment.

The catholyte produced can be directly withdrawn from the cell with the separator or be recycled to the cathode compartment for further electrolysis until the desired concentration has been achieved. Similarly, the anolyte produced can be withdrawn directly from the cell with the separator or be recycled to the anode compartment for further electrolysis until the desired concentration has been achieved.

The catholyte produced containing alkali metal hydroxide can be used for alkalization of the chlorate electrolyte before crystallization of chlorate in cell gas and reactor gas scrubbers, or in the precipitation of impurities and regeneration of ion-exchange resins in connection with the dissolution and purification of technical-grade alkali metal chloride. Thus, the catholyte can be used for precipitating hydroxides of alkaline earth metals, iron and aluminium, and in the regeneration of ion-exchange resins in the first and the second step, respectively, for purification of fresh salt solution. The catholyte can also be used in cell gas and reactor gas scrubbers for removing chlorine in hydrogen gas from the chlorate cells and in residual gas from any hydrogen chloride burners used and for chlorine absorbtion from process air from the reactor vessels, respectively. The catholyte can also be used for purification of e.g. chlorine compounds formed in the cell provided with the separator.

The amount of alkali metal hydroxide produced in the cell with the separator may amount to about 50 kg, calculated as sodium hydroxide per metric ton of dry sodium chlorate. Suitably, the amount ranges from 10 to 25 kg, calculated as sodium hydroxide per metric ton of dry sodium chlorate.

The chlorine or hypochlorous acid produced can be used for acidification in the production of alkali metal chlorate. Especially, the electrolyte supplied to the chlorate electrolyzers can be acidified with acid anolyte withdrawn. The addition of acid anolyte can be performed to one of the flows supplied to the preparation of electrolyte for the chlorate electrolysis, e.g. recirculated mother liquor from the chlorate crystallizer and depleted electrolyte from the reactor vessels. Suitably, the addition is effected between the heat exchangers for cooling the electrolyte and the electrolyzers, and is done to the main flow of the electrolyte.

The inventive process is suitably used for producing sodium chlorate or potassium chlorate, preferably sodium chlorate, but other alkali metal chlorates can also be produced. The production of potassium chlorate can be effected by adding a purified potassium chloride solution to an alkalized partial flow of electrolytically produced sodium chlorate, succeeded by precipitation of crystals by cooling and evaporation. The chlorate is suitably produced by a continuous process, but a batchwise process can also be used.

The invention will now be described with reference to FIG. 1, schematically illustrating a plant for producing sodium chlorate according to the invention. Further, the production of anolyte and catholyte in a cell equipped with a diaphragm is described, but a cell having a membrane is also usable.

Sodium chloride in the form of a technical-grade salt and raw water are supplied to the preparation of salt slurry (1). Such a preparation is disclosed e.g. in EP-A-0 498 484. The thus-purified salt slurry is used for preparing electrolyte (2) for producing chlorate, together with chlorate electrolyte from the reaction vessels (5) and mother liquor from the chlorate crystallizer (8). The thus-concentrated electrolyte contains from 100 to 140 g of sodium chloride/liter, and from 500 to 650 g of sodium chlorate/liter, preferably from 110 to 125 g of sodium chloride/liter and from 550 to 580 g of sodium chlorate/liter. The electrolyte is cooled and pH-adjusted (3) within the interval of from 5.5 to 6.5 by adding acid anolyte from the diaphragm cell (12) and optionally fresh hydrochloric acid, whereupon the electrolyte is supplied to the cells of the chlorate electrolyzer (4). The total flow to the chlorate cells normally is from 75 to 200 $m^3$ of electrolyte per metric ton of sodium chlorate produced. Each chlorate cell operates at 50°–100° C., suitably 60°–80° C., at a current density of from about 10 to about 100 A/liter of circulating electrolyte. The chlorate electrolyte is conducted from (4) to the reactor (5) where the reaction to form chlorate continues. Some of the chlorate electrolyte is recycled from (5) to (2), some to the anode and cathode compartments in (12) and some for alkalization and electrolyte filtration (6) and final pH adjustment (7) before (8). The thus-alkalized electrolyte from (7) is evaporated in (8), sodium chlorate crystallizing and being withdrawn over a filter or via a centrifuge while water driven off is condensed. The mother liquor, which is saturated with respect to chlorate and contains high contents of sodium chloride, is recycled directly to (2) and also via the cell gas scrubbers (9) and the reactor gas scrubbers (10) to (2) and/or (5).

Alkaline catholyte produced in the cathode compartment of the diaphragm cell is used for alkalized the chlorate electrolyte in (6) and (7), in order, respectively, to avoid driving off chlorine compounds in (8) and to precipitate metal impurities as metal hydroxides. Further, the alkaline catholyte is used in the scrubber system for cell gas, reactor gas and dialysis gas (9, 10 and 11, respectively) for absorbing acid components in the gas flows from (4), (5) and (12), respectively.

The chlorine formed at the anode is immediately dissolved in the electrolyte and hydrolyzed to hypochlorous acid. After withdrawal from the cell, the pH of the anolyte is about 5.5. The anolyte withdrawn is passed to pH adjustment (3) before the chlorate electrolyzers (4).

The hydrogen gas formed in (4) is led to (9), and the gases leaving (5) are led to (10) while the gas from the cathode compartment in (12) is led to (9), (10) or separate dialysis scrubbers (11). Purified hydrogen gas can be used e.g. for different syntheses or as fuel.

The invention and its advantages will be illustrated in more detail in the following Example, which is by no means intended to be limitative of the invention. In the description, the claims and the Example, the values indicated in per cent and parts are per cent by weight and parts by weight, unless otherwise stated.

EXAMPLE 1

Chlorate electrolyte containing 110 g of NaCl/l and 600 g of $NaClO_3$/l as well as minor amounts of $Na_2Cr_2O_7$, $NaClO_4$ and $Na_2SO_4$ was pumped through the anode compartment of an electrolytic cell at a rate of 10–20 l/min. Prior to electrolysis, the pH of the chlorate electrolyte was about 6 and the temperature about 50° C.

The cell was a laboratory cell provided with a diaphragm of sintered polyethylene. The electrode area was 1 $dm^2$. A dimensionally stable chlorine anode of titanium (DSA) and an uncoated titanium cathode were used. The gap between the diaphragm and the respective electrode was 7 mm. The cell volume was 2 l.

The chlorate electrolyte was pumped through the anode compartment at a rate of 10–°l/min. Catholyte was circulated by pumping at a rate of about 4 l/min through the cathode compartment and a 2-1 reactor having an overflow. The catholyte was supplied with the same chlorate electrolyte at a rate of 0.14 l/min.

Electrolysis was conducted at an electrolyte temperature of 50°–70° C., a current density of 1–3 kA/m2 and a pH of up to 11.8 in the catholyte and a pH of 5–6 in the anolyte. Current was varied between 10 and 30 A.

Under all operational conditions, current efficiency exceeded 90% and in most cases 95%. Current efficiency was calculated as the quotient between actual and theoretical maximum production of sodium hydroxide. The production of hydroxide ions was determined by analyzing the hydroxide ion content in the catholyte and multiplying it by the collected flow. Related to the production of protons and hydroxide ions expressed as sodium hydroxide and hydrochloric acid, energy consumption was between 2000 and 2300 kWh/metric ton of sodium hydroxide plus an equivalent amount of hydrochloric acid. By "equivalent amount of hydrochloric acid" is here meant the total amount of hydrochloric acid and hypochlorous acid formed in the chlorine hydrolysis, calculated as pure hydrochloric acid.

I claim:

1. A process for producing alkali metal chlorate comprising:

(a) electrolyzing purified alkali metal chloride to produce an electrolyzed solution;

(b) further reacting the electrolyzed solution to produce alkali metal chlorate solution;

(c) separating the alkali metal chlorate from a first portion of the solution in step (b);

(d) diverting a second portion of the alkali metal chlorate solution of step (b) and feeding the diverted second portion as an electrolyte to a electrolytic cell provided with a separator;

(e) electrolyzing the electrolyte from step (d) to thereby form a catholyte containing alkali metal hydroxide and an anolyte containing hypochlorous acid; and (f) using at least a portion of the alkali metal hydroxide and the hypochlorous acid produced in step (e) for the production of alkali metal chlorate.

2. A process as claimed in claim 1, wherein the concentration of chlorate in the electrolyte supplied to the cell in step (d) ranges from 300 to 650 g/l.

3. A process as claimed in claim 2, wherein the separator in the cell of step (d) is a diaphragm.

4. A process as claimed in claim 2, wherein the separator in the cell of step (d) is an ion-selective membrane.

5. A process as claimed in claim 1, wherein the separator in the cell of step (d) is a diaphragm.

6. A process as claimed in claim 5, wherein the catholyte produced in step (e) is used for alkalization of the chlorate electrolyte for crystallization of chlorate in cell gas and reactor gas scrubbers or in the precipitation of impurities and regeneration of ion-exchange resins in connection with dissociation and purification of technical-grade alkali metal chloride.

7. The process according to claim 5 comprising:

(g) using catholyte produced in step (e) for production of chlorine dioxide in an integrated process where the process for production of alkali metal chlorate and the process for production of chlorine dioxide are combined and in which alkali metal ions are not supplied systematically.

8. A process as claimed in claim 1, wherein the separator in the cell of step (d) is an ion-selective membrane.

9. A process as claimed in claim 8, wherein the membrane is cation-selective.

10. A process as claimed in claim 8, wherein the catholyte produced in step (e) is used for alkalization of the chlorate electrolyte for crystallization of chlorate in cell gas and reactor gas scrubbers or in the precipitation of impurities and regeneration of ion-exchange resins in connection with dissociation and purification of technical-grade alkali metal chloride.

11. The process according to claim 8 comprising:

(g) using catholyte produced in step (e) for production of chlorine dioxide in an integrated process where the process for production of alkali metal chlorate and the process for production of chlorine dioxide are combined and in which alkali metal ions are not supplied systematically.

12. A process as claimed in claim 1, wherein the catholyte produced in step (e) is used for alkalization of the chlorate electrolyte for crystallization of chlorate in cell gas and reactor gas scrubbers or in the precipitation of impurities and regeneration of ion-exchange resins in connection with dissociation and purification of technical-grade alkali metal chloride.

13. The process according to claim 12 comprising:

(g) using catholyte produced in step (e) for production of chlorine dioxide in an integrated process where the process for production of alkali metal chlorate and the process for production of chlorine dioxide are combined and in which alkali metal ions are not supplied systematically.

14. A process as claimed in claim 11, wherein hypochlorous acid is used in the production of alkali metal chlorate.

15. A process as claimed in claim 1, wherein the cell of step (d) includes anode and cathode compartments, and wherein the alkali metal chlorate of step (b) is added to the anode and the cathode compartments as an electrolyte.

16. A process as claimed in claim 1, wherein the catholyte produced in step (e) is used for the production of chlorine dioxide in an integrated process where a process for production of alkali metal chlorate and a process for production of chlorine dioxide are combined, and in which alkali metal ions cannot be supplied systematically.

17. A process as claimed in claim 1, wherein the pH in the produced anolyte is in the range of from 4.5 up to 6.5.

18. A process for producing alkali metal chlorate comprising:

(a) electrolyzing purified alkali metal chloride to produce an electrolyzed solution;

(b) further reacting the electrolyzed solution to produce alkali metal chlorate solution;

(c) separating the alkali metal chlorate from a first portion of the solution in step (b);

(d) diverting a second portion of the alkali metal chlorate solution of step (b) and feeding the diverted second portion as an electrolyte to a electrolytic cell provided with a separator and containing anode and cathode compartments;

(e) electrolyzing the electrolyte from step (d) to thereby form a catholyte containing alkali metal hydroxide and form chlorine which is dissolved in an anolyte to form hypochlorous acid in the anode compartment; and (f) using at least a portion of the alkali metal hydroxide and the hypochlorous acid produced in step (e) for the production of alkali metal chlorate.

19. A process as claimed in claim 18, wherein the pH in the produced anolyte is in the range of from 4.5 up to 6.5.

* * * * *

UNITED STATES PATENT AND TRADEMARK OFFICE

CERTIFICATE OF CORRECTION

PATENT NO. : 5,419,818
DATED : May 30, 1995
INVENTOR(S) : Johan WANNGARD

It is certified that error appears in the above-indentified patent and that said Letters Patent is hereby corrected as shown below:

Claim 14, at column 8, line 51, amend "claim 11" to --claim 1--.

Signed and Sealed this

First Day of August, 1995

Bruce Lehman

*Attest:*

BRUCE LEHMAN

*Attesting Officer*

*Commissioner of Patents and Trademarks*